United States Patent [19]

Kubisch et al.

[11] Patent Number: 5,062,466

[45] Date of Patent: Nov. 5, 1991

[54] COUNTERGRAVITY CASTING APPARATUS AND METHOD

[75] Inventors: John G. Kubisch, Midland; James B. Mercer, Saginaw; Wilmer G. Schaeff, Saginaw; Thomas E. Wenzel, Saginaw, all of Mich.

[73] Assignee: General Motors Corporation, Detroit, Mich.

[21] Appl. No.: 698,560

[22] Filed: May 10, 1991

[51] Int. Cl.[5] ..... B22D 18/06

[52] U.S. Cl. ..... 164/7.1; 164/63; 164/160.1; 164/255

[58] Field of Search ..... 164/7.1, 63, 119, 255, 164/306, 137, 60.1

[56] References Cited

U.S. PATENT DOCUMENTS

| | | | |
|---|---|---|---|
| 4,340,108 | 7/1982 | Chandley et al. | 164/63 |
| 4,606,396 | 8/1986 | Chandley et al. | 164/255 |
| 4,616,691 | 10/1986 | Voss | 164/255 |
| 4,658,880 | 4/1987 | Voss | 164/255 |
| 4,745,962 | 5/1988 | Mercer et al. | 164/255 |
| 4,787,434 | 11/1988 | Cleary et al. | 164/34 |
| 4,848,439 | 7/1989 | Plant | 164/16 |
| 4,858,672 | 8/1989 | Chandley | 164/255 X |
| 4,862,945 | 9/1989 | Greanias et al. | 164/255 X |
| 4,862,946 | 9/1989 | Chandley | 164/255 X |
| 4,874,029 | 10/1989 | Chandley | 164/34 |
| 4,957,153 | 9/1990 | Chandley | 164/7.1 |
| 4,971,131 | 11/1990 | Aubin et al. | 164/7.1 |
| 4,977,948 | 12/1990 | Chandley | 164/255 |

*Primary Examiner*—J. Reed Batten, Jr.

*Attorney, Agent, or Firm*—Reising, Ethington, Barnard, Perry & Milton

[57] ABSTRACT

In vacuum countergravityy casting a melt into a mold sealingly engaged to a vacuum container by an elastomeric sealing gasket, the sealing gasket is isolated from the heat of an underlying source of the melt and from contact therewith during casting by substantially binderless refractory particulates, such as loose foundry sand, held in a particulate-receiving space in the container about a lower, melt-engaging portion of the mold by a negative differential pressure established between the inside and outside of the particulate-receiving space.

23 Claims, 2 Drawing Sheets

COUNTERGRAVITY CASTING APPARATUS AND METHOD

FIELD OF THE INVENTION

The present invention relates to countergravity casting of a melt into a casting mold sealingly engaged to a vacuum chamber via a sealing gasket and, more particularly, to means for isolating the sealing gasket from the heat of an underlying source of the melt as well as contact therewith during casting in a manner that permits a substantial reduction in the amount of costly bonded mold particulates required for the mold and that is applicable to vertically as well as horizontally parted molds.

BACKGROUND OF THE INVENTION

A vacuum countergravity casting process using a gas permeable mold is described in such prior patents as the Chandley et al U.S. Pat. Nos. 4,340,108 issued July 20, 1982, and 4,606,396 issued Aug. 19, 1986. That countergravity casting process involves providing a mold having a porous, gas permeable upper mold member (cope) and a lower mold member (drag) engaged together, sealing the bottom lip of a peripheral wall of a vacuum chamber to the mold such that the vacuum chamber confronts the gas permeable upper mold member, immersing the bottom side of the lower mold member in an underlying pool of the melt, and evacuating the chamber sufficiently to draw the melt upwardly through one or more ingate passages in the lower mold member and into one or more mold cavities formed between the upper and the lower mold members.

The mold and the vacuum chamber typically are sealed together using a sealing gasket compressed between the bottom lip of the peripheral wall and an upwardly facing sealing surface or flange formed (molded) on the mold, either the lower or the upper mold member. Various mechanical clamping mechanisms have been provided for clamping the vacuum chamber and the mold together to compress the seal therebetween; e.g., as shown in U.S. Pat. Nos. 4,340,108; 4,616,691, and 4,658,880.

U.S. Pat. No. 4,745,926 provides an upstanding dam or levee formed (molded) on the lower mold member (drag) so as to circumscribe the parting plane between the upper and the lower mold members and the sealing gasket therebetween to permit deep immersion of the lower mold member in the underlying melt pool while isolating the sealing gasket from contact with the melt. However, provision of the upstanding dam on the lower mold member increases the amount of costly resin-bonded mold particulates (e.g., resin-bonded sand) required to make the mold. A refractory sealing gasket is typically used to withstand the heat of the melt pool during casting when the lower mold member is immersed therein.

Moreover, an upstanding dam of the type described in the patent cannot be formed on vertically parted molds without significantly increasing the complexity of the mold-forming tooling. As a result, past practice for casting a vertically parted mold has involved mounting the mold on a separate, underlying resin-bonded sand slab core (also known as a drag slab) on which the dam can be molded in accordance with standard molding practice. However, use of the slab core increases the number of mold components required for casting and significantly increases the amount of costly resin-bonded mold particulates required.

The Voss U.S. Pat. No. 4,616,691 issued Oct. 14, 1986, discloses sealing the bottom lip of the peripheral wall of the vacuum chamber to a countergravity casting mold using a reusable, positively sealing elastomeric sealing gasket carried on the bottom lip. During casting when the mold is immersed in the melt pool, the elastomeric sealing gasket is thermally insulated, conduction wise, from the heat of the underlying melt pool by the mold-forming material of the drag and shielded from the radiant heat of the melt pool by a skirt depending from the peripheral wall. The sealing gasket is insulated, conduction wise, from the pool by a substantially thickened upstanding shoulder or ridge formed on the drag and is sealed to the mold at a site atop the mold which is thermally remote from the melt pool. However, mold constructions of this type adapted to thermally protect the elastomeric sealing gasket require an increased amount of the costly resin-bonded mold particulates.

It is an object of the present invention to provide an improved countergravity casting apparatus and process wherein a sealing gasket between a casting mold and a vacuum chamber is isolated from the heat of an underlying melt as well as from contact therewith during casting in a manner that permits a substantial reduction in the amount of costly resin-bonded mold particulates needed for the mold.

It is another object of the invention to provide an improved countergravity casting apparatus and process wherein a sealing gasket between a casting mold and a vacuum chamber is isolated from the heat of an underlying melt as well as from contact therewith during casting in a manner applicable to vertically as well as horizontally parted molds.

It is another object of the invention to provide an improved countergravity casting apparatus and process wherein a sealing gasket between a casting mold and a vacuum chamber is isolated from the heat of an underlying melt pool as well as from contact therewith during casting by particulates held about a lower, melt-engaging portion of the mold between the seal and the melt pool by a negative differential pressure established between the inside and the outside of a particulate-receiving space.

It is another object of the present invention to provide an improved countergravity casting apparatus and process wherein a casting mold is received in a container having a first chamber confronting an upper portion of the mold, a second chamber having an open bottom and confronting a lower melt-engaging portion of the mold, and a sealing gasket between the first and the second chambers such that the second chamber can be evacuated independently of the first chamber to hold particulates in a particulate-receiving space to isolate the seal from the heat of an underlying melt pool as well as contact therewith during casting.

It is another object of the present invention to provide an improved countergravity casting apparatus and process wherein a casting mold is received in a container having a first chamber confronting an upper portion of the mold, a second chamber having an open bottom and confronting a lower melt-engaging portion of the mold, and a sealing gasket between the first and the second chambers such that the first chamber can be evacuated independently of the second chamber after the lower mold portion and the melt source are engaged so as to draw only clean melt (devoid of slag, dross, and other foreign matter which may be floating on the melt surface) upwardly into the mold cavity during casting.

SUMMARY OF THE INVENTION

The present invention contemplates a countergravity casting apparatus and process wherein a casting mold includes a mold cavity communicated to a lower, melt-engaging portion by a melt inlet and is received in a container having a depending skirt and a chamber confronting the mold when the container and the mold are engaged. The container and the mold are engaged by a sealing gasket positioned above the lower, melt-engaging mold portion and isolated from the heat of an underlying melt pool and from contact therewith during casting by particulates, such as preferably substantially binderless refractory particulates, held in an open bottom, particulate-receiving peripheral space defined between the skirt and the mold. The particulates are held in the peripheral space by a negative differential pressure established by suitable means, such as a vacuum pump, between the inside and the outside of the space. When the mold and melt are engaged during casting, the particulates held in the peripheral space establish a positive vacuum seal with the melt about the mold.

The particulates are held in the peripheral space before, during, and after engagement of the mold and melt at a casting station. Subsequently, when the melt-filled mold is located at a de-mold station, the negative differential pressure can be discontinued so as to discharge the particulates by gravity from the peripheral space.

In one embodiment of the invention, the container includes a first chamber confronting an upper portion of the mold, a second chamber having an open bottom end and confronting the lower melt-engaging portion of the mold to define an open bottom, particulate-receiving peripheral space thereabout, and a seal disposed between the first and second chambers for sealingly engaging the container and the mold. The second chamber is communicated to suitable means, such as a vacuum pump, for establishing the desired negative differential pressure in the particulate-receiving peripheral space for holding the particulates therein between the seal and the lower mold portion during the casting operation. Preferably, the container includes a third chamber proximate the second chamber and in gas flow communication therewith via a gas permeable, particulate impermeable member disposed between the second and third chambers.

The first chamber is communicated to another vacuum pump for establishing a sufficient negative differential pressure therein independently of the second chamber after the melt and the mold are engaged to draw the melt upwardly into the mold cavity. Establishment of the negative differential pressure in the first chamber subsequent to melt/mold engagement in accordance with this aspect of the invention prevents slag, dross, and other foreign matter which may be floating on the melt from being drawn into the mold during the casting operation.

The present invention is especially useful, although not limited to, countergravity casting a melt into a vertically parted mold so as to eliminate the need for a separate slab core and substantially reduce the amount of costly resin-bonded mold particulates required for the casting operation.

DESCRIPTION OF THE DRAWINGS

The invention may be understood better when considered in light of the following detailed description of certain specific embodiments thereof which are given hereafter in conjunction with the following drawings.

DETAILED DESCRIPTION OF THE INVENTION

Figure 1:
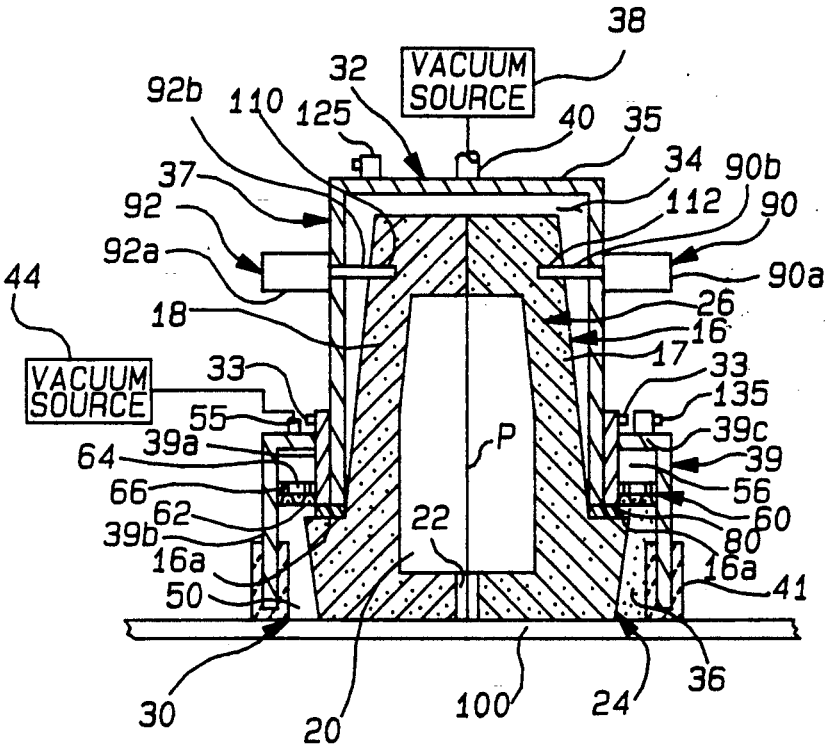
FIG. 1 is side sectional view of one embodiment of the invention showing the container positioned and assembled about a vertically parted casting mold.
Figure 2:
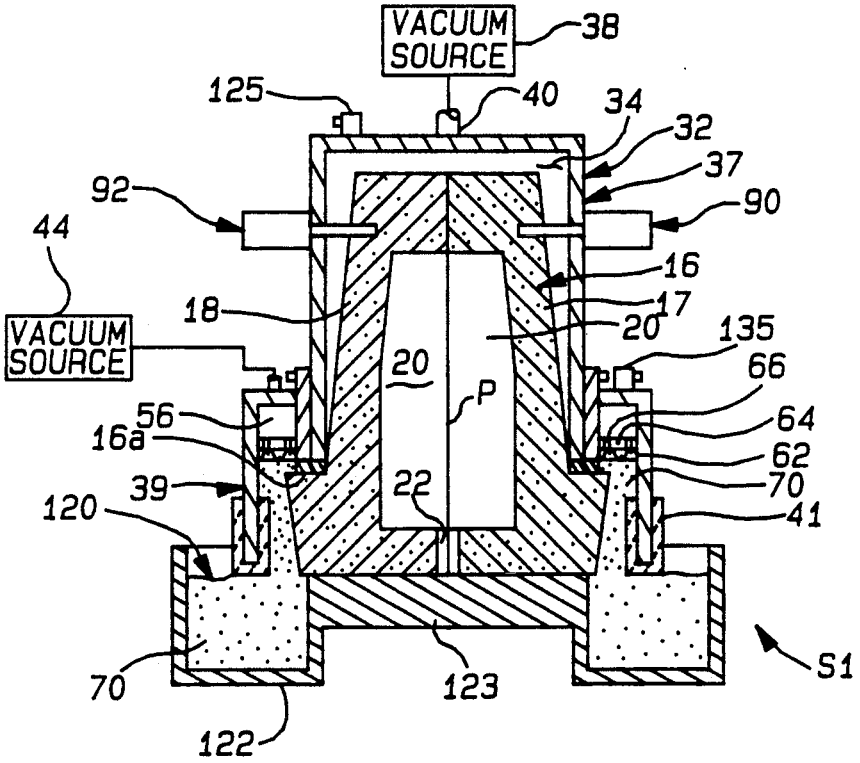
FIG. 2 is a side sectional view similar to FIG. 1 showing the assembled container and mold positioned on a source of particulates with the particulates drawn upwardly into a peripheral space about the lower mold portion.
Figure 3:
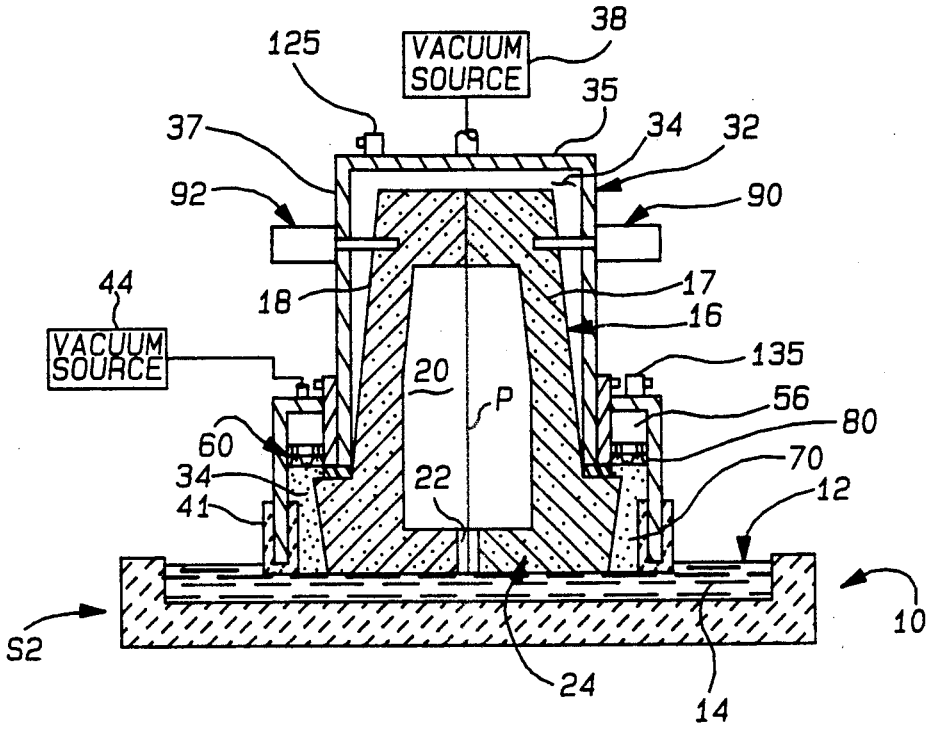
FIG. 3 is a side sectional view of the assembled container and the mold positioned at a casting station with the lower mold portion immersed in an underlying melt pool.

FIGS. 1–4 illustrate a vacuum countergravity casting apparatus in accordance with one embodiment of the present invention wherein a vessel 10 (e.g., a refractory crucible) contains a pool 12 of the melt 14 (e.g., molten metal) to be drawn upwardly into the vertically parted mold 16 (e.g., see FIG. 3). The mold 16 includes a pair of porous, gas permeable mold members 17,18 joined adhesively together at parting surfaces forming a generally vertical parting plane P therebetween. Defined between the mold members 17,18 is a mold cavity 20 to be filled with the melt 14 from the pool 12 through one or more melt inlets 22 (only one shown) when the mold cavity 20 is evacuated with the lower mold portion 24 immersed in the pool 12. To this end, the melt inlet 22 extends from the lower, melt-engaging mold portion 24 to the mold cavity 20 to place them in melt flow communication.

The mold members 17,18 can be made of resin-bonded sand in accordance with known mold practice wherein a mixture of foundry sand or equivalent particulates and a bonding material is formed to shape and cured or hardened against a contoured pattern (not shown) having the desired complementary contour or profile to form the parting surfaces with portions of the mold cavity 20 and the melt inlet 22 and other features shown. The bonding material may comprise inorganic or organic thermal or chemical setting plastic resin or equivalent bonding material. The bonding material is usually present in a minor percentage of the mixture, such as about 5% by weight or less of the mixture.

In accordance with the present invention, the mold 16 is sealingly received in the open bottom end or mouth 30 of a container 32 that includes a first vacuum chamber 34 confronting the upper portion 26 of the mold and an enlarged second vacuum chamber 36 confronting the lower, melt-engaging portion 24 of the mold when the container 32 is engaged to the mold 16 as shown in FIGS. 1–3. The first chamber 34 is defined by an upper horizontal wall 35 and a depending, peripheral wall 37 of the container 32 and is communicated to a vacuum source 38, such as a vacuum pump, through a conduit 40 sealingly connected to the upper wall 35 of the container 32 so that the mold cavity 20 can be evacuated through the gas permeable mold members 17,18 to draw the melt 14 through the melt inlet 22 into the mold cavity 20 when the lower mold portion 24 is immersed in the pool 12 (as shown in FIG. 3).

The second vacuum chamber 36 is formed by a lower, depending peripheral skirt or wall 39 of the container 32. As is apparent from the Figures, the lower peripheral skirt 39 is spaced about the periphery of the lower, melt-engaging mold portion 24 so as to define an open bottom, particulate-receiving peripheral space 50 therebetween. A lower region of the skirt 39 that will be immersed in the melt 14 may have a protective refractory or ceramic coating 41 (e.g., an alumina/graphite mixture) applied thereon to protect the skirt 39 from damage by contact with the melt. The lower peripheral skirt 39 may comprise separate inner and outer sides 39*a*,39*b* and a top side 39*c* joined (e.g., welded) together. The skirt 39 is fastened to the upper peripheral wall 37 by a plurality of peripherally spaced fasteners 33. A sealing gasket (not shown) is located between the wall 37 and skirt 39 where they are overlapped and fastened together to insure a gas tight connection therebetween.

The second chamber 36 is communicated to a vacuum source 44, such as vacuum pump, through a third chamber 56 formed between the inner and outer sides 39*a*,39*b* of the lower peripheral skirt 39 and a conduit 55 sealingly connected to the top side 39*c* of the lower peripheral skirt 39. The third chamber 56 can be communicated to the ambient atmosphere via a bleeder valve 135 in the top side 39*c*.

Although separate vacuum sources 38,44 are described above, the invention envisions communicating the first chamber 34 and third chamber 56 to the same vacuum source (not shown) with suitable valving (not shown) to control application of reduced/ambient pressures to the chambers 34,56 as necessary to practice the invention.

A gas permeable, particulate impermeable member 60 is affixed between the inner and outer sides 39*a*,39*b* to separate the second and third chambers 36,56. The gas permeable, particulate impermeable member 60 comprises a lower apertured brass or other metal screen 62 and an upper screen support 64. Screen support 64 includes apertures 66 that are larger than the apertures (not shown) of the screen 62. For reasons which will become apparent below, the screen apertures are selected to provide desired gas flow communication between the second and third chambers 36,56 but are sufficiently small so as not to allow the substantially binderless refractory particulates 70 (FIGS. 2 and 3) held in the peripheral space 50 to pass through to the third chamber 56.

A reusable, resilient, thermally degradable sealing gasket 80 (e.g., silicone rubber, fluoro-elastomeric rubber or foamed plastic) is preferably disposed between the first and second chambers 34,36 for sealingly engaging the container 32 and the mold 16. However, other gasket materials, such as a refractory gasket referred to as Fiberfax, can be used in practicing the invention. The sealing gasket 80 is typically carried on (e.g., adhered to) the bottom lips of the upper peripheral wall 37 and the inner side 39*a* of the lower peripheral skirt 39 for positively sealingly engaging the upwardly facing shoulder 16*a* extending about the periphery of the mold 16 when the mold 16 is assembled and clamped to the container 32 by the fluid (e.g., pneumatic) clamps 90,92 mounted on the upper peripheral wall 37.

Assembly of the mold 16 to the container 32 is effected by supporting the mold on a suitable support 100, FIG. 1, and moving the container 32 downwardly over the mold until the bottom lip of the lower peripheral skirt 39 rests on the support 100. Then, the cylinders 90*a*,92*a* of the clamps 90,92 are actuated to extend the plungers 90*b*,92*b* into respective laterally extending passages 112,110 formed (molded) in the upper mold portion 26 and aligned with the clamps 90,92 when the mold 16 and the container 32 are positioned together on the support 100. The mold 16 is thereby clamped to the container 32 with the sealing gasket 80 providing a peripheral gas tight seal therebetween. Although one particular type of clamp is illustrated in the Figures, the invention can be practiced using other types known in the art; e.g., as shown in U.S. Pat. Nos. 4,340,108; 4,616,691; and 4,658,880, the teachings of which are incorporated herein by reference.

In accordance with the invention, the assembled mold 16/container 32 are positioned at a particulate pick-up station S1 illustrated in FIG. 2 where the substantially binderless refractory particulates 70 referred to above are sucked up into the peripheral space 50 defined between the skirt 39 and the lower, melt-engaging portion 24 of the mold 16. As shown in FIG. 2, at the particulate pick-up station S1, a bed 120 of substantially binderless, loose refractory particulates 70 (e.g., loose foundry sand) is provided in an underlying container 122 having a central pedestal support 123. The mold 16 is supported on the pedestal support 123 while the bottom lip of the skirt 39 (mouth 30 of container 32) rests in the bed 120. At this time, the bleeder valve 135 is closed to the ambient atmosphere, and the third chamber 56 is then evacuated by the vacuum source 44 to establish a sufficient negative differential pressure between the inside and the outside of the second chamber 36 to draw the loose particulates 70 upwardly into the peripheral space 50 about the lower mold portion 24.

The particulates 70 typically comprise loose, binderless foundry sand (e.g., silica sand of 75 mesh size AFS) when the melt 14 comprises molten iron. However, other refractory or ceramic particulate materials exhibiting appropriate heat insulating properties and capability of withstanding the melt heat and contact with the melt without losing their effectiveness in protecting the sealing gasket 80 during the casting operation may be used in practicing the invention. Preferably the particulates comprise a refractory or ceramic material which is substantially non-reactive with the melt 12 so as not to contaminate the melt. The amount, size, and composition of particulates 70 used in practicing the invention will depend upon the composition of the melt 12 being cast, its temperature, its reactivity toward the particulates, and the immersion time of the mold 16/particulates 70 in the melt 12.

Once the peripheral space 50 is filled with the particulates 70, the assembled mold 16/container 32 are raised above the bed 120 while maintaining the negative differential pressure in the second chamber 36 via evacuation of the third chamber 56. The loose, substantially binderless particulates 70 are held in the peripheral space 50 between the seal 80 and the lower mold portion 24 by the negative differential pressure established between the inside and outside of the peripheral space 50.

It is apparent from FIG. 2 that the vacuum applied in the second chamber 36 must be at least sufficient to draw the particulates 70 upwardly into the peripheral space 50 and to exert an upward force on the particulates 70 which is at least equal to their weight to hold them in position in the space 50. For purposes of illustration only, a vacuum level in the peripheral space 50 of approximately 250 inches of water and above has been used to draw up and hold approximately 13 pounds of loose, binderless silica sand of 75 mesh size AFS in the peripheral space 50.

The assembled mold 16/container 32 are transported from the pick-up station S1 to a casting station S2, FIG. 3, where the assembly is positioned above the pool 12 of the melt 14 (e.g., molten metal) to be countergravity cast into the mold cavity 20. The countergravity casting process is carried out by relatively moving the assembled mold 16/container 32 and pool 12 to immerse (engage) the lower mold portion 24 in the pool 12 such that the melt inlet 22 is exposed to the melt 14. During this movement, the first chamber 34 is maintained at ambient pressure (atmospheric pressure) by communicating the first chamber 34 to the ambient atmosphere via a suitable bleeder valve 125 on the upper wall 35 of the container 32. Once the lower mold portion is immersed in the pool 12, the valve 125 is closed to the atmosphere, and the first chamber 34 is evacuated (by actuation of vacuum source 38) to a sufficient extent to urge the melt upwardly through the melt inlet 22 into the mold cavity 20 to fill it with the melt. During immersion of the lower mold portion 24 in the pool 12, the particulates 70 in the peripheral space 50 establish a positive vacuum seal with the melt 14 about the lower mold portion 24, facilitating establishment of a consistent and controllable vacuum level in the first chamber 34.

Only after the lower mold portion is immersed in the melt 14 is the first chamber 34 evacuated. This method aspect of the invention is effective to prevent slag, dross, and other foreign matter which may be floating on the surface of the pool 12 from being drawn up into the mold cavity 20 and adversely affecting casting quality.

As is apparent from FIG. 3, during casting when the lower mold portion 24 is immersed in the pool 12, the sealing gasket 80 is brought in proximity to the surface of the pool and will be exposed to significant heat that radiates from the pool. If during the casting of successive molds 16, the sealing gasket 80 repeatedly reaches temperatures above its thermal degradation temperature (e.g., about 600° F. for silicone rubber and about 450° F. for fluoroelastomeric rubber), the sealing gasket 80 can be thermally degraded (thermal degradation typically being characterized by flattening, hardening, and cracking of the gasket and lose its effectiveness as a vacuum seal).

In accordance with the present invention, the useful life of the sealing gasket 80 in casting successive molds 16 is extended by minimizing thermal degradation thereof during casting. In particular, during the casting operation, the particulates 70 held in the peripheral space 50 thermally insulate the elastomeric sealing gasket 80 from the heat of the pool 12. The particulates 70 also provide a barrier to prevent contact of the sealing gasket 80 with the melt as the lower mold portion 24 is progressively immersed in the pool. For example, the melt 14 penetrating into the mass of particulates 70 will solidify in the interstitices therebetween to block contact between the melt and sealing gasket 80.

Importantly, protection of the sealing gasket 80 is achieved by the substantially binderless particulates 70 so as to provide a substantial reduction in the amount of costly resin-bonded sand needed to make the mold 16. Namely, the present invention eliminates the need for mounting the vertically parted mold 16 on an underlying resin-bonded sand slab core as heretofore practiced in the art. Instead, a relatively small amount of the substantially binderless refractory particulates 70 (e.g., approximately 13 lbs. of the aforementioned silica sand) is held in the peripheral space 50 to isolate and protect the seal 80 during casting. The amount of costly resin-bonded sand needed for the casting mold thereby can be substantially reduced when practicing the present invention using a vertically parted test mold 16 and a sealing gasket 80 isolated by the particulates 70 in the manner illustrated in the Figures.

In casting a horizontally parted mold (not shown), the present invention eliminates the need for an upstanding dam on the drag as heretofore practiced in accordance with U.S. Pat. No. 4,745,962.

After solidification of the melt 14 in at least the melt inlet 22, the assembled mold 16/container 32 are raised away from the pool 12 to withdraw the lower mold portion 24 from engagement with the melt 14. During this operation, the negative differential pressure is maintained in the second chamber 36 via evacuation of the third chamber 56 to hold the particulates 70 in the peripheral space 50. The vacuum in the first chamber 34 can be discontinued at this time by terminating operation of vacuum source 38 and opening bleeder valve 125 to the atmosphere.

Figure 4:
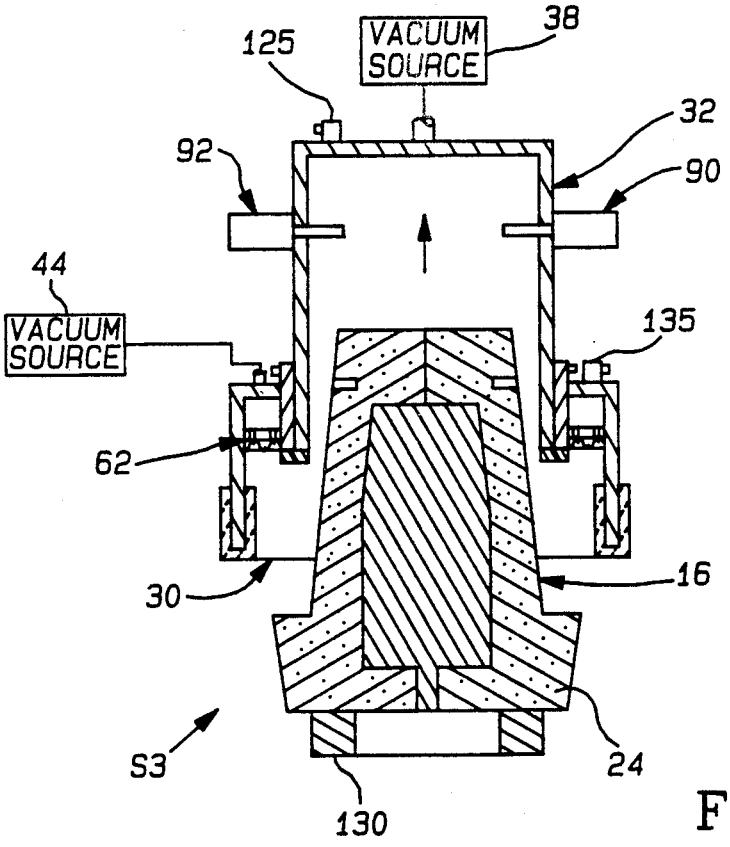
FIG. 4 is a side sectional view of the container and the melt-filled mold disengaged at a demold station.

Following withdrawal of the assembled mold 16/container 32 from the pool 12, the assembly is transferred to a de-mold station S3, FIG. 4, where the mold 16 is placed on a grate 130. The negative differential pressure in the second chamber 36 is then discontinued by terminating operation of the vacuum source 44 and opening the bleeder valve 135 to atmosphere to provide ambient pressure in the chamber 36. This equalizes pressure inside and outside the peripheral space 50 to effect discharge of the particulates 70 by gravity therefrom for ultimate return to the bed 120 and reuse in connection with another mold 16.

In practicing the invention in the manner described above the container 32 is typically connected to a manipulating arm (not shown) of the type illustrated in U.S. Pat. No. 4,340,108 for movement relative to the mold 16 and for transport of the assembled mold 16/container 32 to the various stations S1, S2, and S3, the teachings of U.S. Pat. No. 4,340,108 being incorporated herein by reference to this end.

While the invention has been described in terms of specific embodiments thereof, it is not intended to be limited thereto but rather only to the extent set forth hereafter in the following claims.

We claim:

1. Countergravity casting apparatus, comprising:

a) a casting mold having a mold cavity for receiving melt and a melt inlet communicating said mold cavity with a lower mold portion adapted to engage an underlying source of said melt, b) a container having a depending skirt and defining a chamber with an open bottom end, said container engaging said mold such that said chamber confronts the mold so as to form an open bottom peripheral space defined by said skirt and said lower mold portion, c) a sealing gasket disposed between the mold and the container above said lower mold portion, d) particulates disposed in said peripheral space between said sealing gasket and said lower mold portion, and e) means for establishing a negative differential pressure between the inside and the outside of said peripheral space sufficient to hold the particulates therein such that the particulates thermally isolate said sealing gasket from heat from and contact with said source.

2. The apparatus of claim 1 wherein the sealing gasket comprises an elastomeric, thermally degradable material.

3. The apparatus of claim 1 wherein the mold comprises a plurality of mold members sealingly engaged at an upstanding parting plane therebetween.

4. Countergravity casting apparatus, comprising:

a) a casting mold including an upper mold portion at least in part defining a mold cavity for receiving melt and a lower mold portion having a melt inlet adapted for communicating an underlying source of said melt and said mold cavity, b) a container receiving the mold, said container having a first chamber confronting the upper portion of the mold and a second chamber having an open bottom end and confronting the lower portion of the mold so as to form an open bottom, peripheral space about said lower mold portion, c) a sealing gasket disposed between the first and second chambers for sealingly engaging the container and the mold, d) particulates disposed in said peripheral space about said lower mold portion, e) means for establishing a negative differential pressure between the inside and the outside of said second chamber sufficient to hold the particulates in said peripheral space about said lower mold portion to thermally isolate said sealing gasket from heat from and contact with said source, and f) means for establishing a negative differential pressure between the inside and the outside of said first chamber when said melt inlet and said source are engaged sufficient to urge the melt upwardly through the melt inlet into the mold cavity.

5. The apparatus of claim 4 wherein the mold comprises a plurality of mold members sealingly engaged at an upstanding parting plane therebetween.

6. The apparatus of claim 4 wherein the particulates comprise loose, substantially binderless particulates.

7. The apparatus of claim 6 wherein the loose particulates comprise loose sand.

8. The apparatus of claim 4 wherein said means for establishing the negative differential pressure in the second chamber comprises a third chamber proximate the second chamber and in gas flow communication therewith, and means for evacuating the third chamber.

9. The apparatus of claim 8 wherein a gas permeable, particulate impermeable member is disposed between the second and third chambers.

10. The apparatus of claim 9 wherein the gas permeable, particulate-impermeable member comprises a screen having gas flow openings that prevent the particulates from passing therethrough from the second chamber to the third chamber when the negative differential pressure is established therein.

11. The apparatus of claim 4 wherein the means for establishing the negative differential pressure in the first chamber comprises means for evacuating said first chamber.

12. The apparatus of claim 4 wherein the sealing gasket comprises an elastomeric, thermally degradable material.

13. In a method of countergravity casting a melt, the steps of:

a) positioning a mold having a mold cavity communicated to a lower mold portion by a melt inlet in a container having a chamber with an open bottom end such that said chamber confronts said lower mold portion as to form an open bottom peripheral space about said lower mold portion, b) positioning a sealing gasket between the mold and the container above said lower mold portion, c) disposing particulates in the peripheral space between said sealing gasket and said lower mold portion, and d) establishing a sufficient negative pressure between the inside and the outside of said peripheral space to hold the particulates therein such that said particulates thermally isolate said sealing gasket from heat from and contact with an underlying source of the melt when said lower mold portion is engaged to said source for casting.

14. The method of claim 13 including disposing an elastomeric, thermally degradable sealing gasket between the container and the mold.

15. The method of claim 13 wherein a vertically parted mold is positioned in the container.

16. A method of countergravity casting a melt, comprising:

a) positioning a mold in a container such that a first chamber of said container confronts an upper mold portion, a second chamber of said container having an open bottom end confronts a lower mold portion to form an open bottom peripheral space about the lower mold portion, and a sealing gasket between said first and second chambers sealingly engages said mold and said container, said upper mold portion defining at least in part a mold cavity for receiving the melt and said lower mold portion having a melt inlet for communicating said mold cavity to an underlying source of said melt, b) disposing particulates in the peripheral space about the lower mold portion, c) establishing a sufficient negative pressure between the inside and the outside of the second chamber to hold the particulates in the open bottom peripheral space about the lower mold portion to thermally isolate said sealing gasket from heat from and contact with said source, d) relatively moving said source and said container with said open bottom end and said melt inlet facing said source to engage said melt inlet and said source, and e) establishing a sufficient negative differential pressure between the inside and the outside of the first chamber when said inlet and said source are engaged to urge the melt upwardly through the melt inlet into the mold cavity.

17. The method of claim 16 wherein the particulates are disposed in the peripheral space by placing the container on a bed of loose, substantially binderless particulates and establishing a negative differential pressure between the inside and the outside of the second chamber sufficient to draw the particulates upwardly from said bed into said peripheral space about said lower mold portion.

18. The method of claim 17 wherein the container is raised above said bed after said peripheral space is filled with said particulates.

19. The method of claim 16 wherein the negative differential pressure is established in the second chamber by evacuating said second chamber.

20. The method of claim 16 wherein the negative differential pressure is established in the first chamber by evacuating said first chamber.

21. The method of claim 16 including relatively moving the container and the source after the mold cavity is filled with the melt to disengage the melt inlet and the source.

22. The method of claim 21 including terminating said negative differential pressure in said second chamber after the melt inlet and the source are disengaged to discharge the particulates from said space.

23. The method of claim 16 wherein a vertically parted mold is positioned in the container.

* * * * *